US009974374B2

(12) United States Patent
Nowack

(10) Patent No.: US 9,974,374 B2
(45) Date of Patent: May 22, 2018

(54) APPLICATOR FOR APPLYING A LIQUID MEDIUM, IN PARTICULAR IN THE COSMETIC FIELD

(71) Applicant: Tetiana Nowack, Berlin (DE)

(72) Inventor: Tetiana Nowack, Berlin (DE)

( * ) Notice: Subject to any disclaimer, the term of this patent is extended or adjusted under 35 U.S.C. 154(b) by 213 days.

(21) Appl. No.: 14/779,216

(22) PCT Filed: Aug. 13, 2014

(86) PCT No.: PCT/EP2014/067344

§ 371 (c)(1),
(2) Date: Sep. 22, 2015

(87) PCT Pub. No.: WO2015/022371

PCT Pub. Date: Feb. 19, 2015

(65) Prior Publication Data

US 2016/0045012 A1 Feb. 18, 2016

(30) Foreign Application Priority Data

Aug. 15, 2013 (DE) ..... 10 2013 216 231
Sep. 13, 2013 (DE) ..... 20 2013 104 192 U

(51) Int. Cl.
*A45D 34/04* (2006.01)

(52) U.S. Cl.
CPC ..... *A45D 34/042* (2013.01); *A45D 34/04* (2013.01); *A45D 2200/054* (2013.01); *A45D 2200/055* (2013.01)

(58) Field of Classification Search
CPC combination set(s) only.
See application file for complete search history.

(56) References Cited

U.S. PATENT DOCUMENTS 4,180,187 A * 12/1979 Ben-Haim ..... B05C 17/0103 192/141
5,775,539 A * 7/1998 Bates ..... B05C 17/0103 222/1
6,022,163 A * 2/2000 Asfur ..... A45D 24/22 132/112
7,854,348 B2 * 12/2010 Wang ..... G01F 11/026 222/326
2004/0045982 A1 3/2004 Herman et al.
2010/0217176 A1 8/2010 Carrara et al.
2013/0121750 A1 5/2013 Sandahl
2013/0264358 A1 10/2013 Fallat, II et al.

FOREIGN PATENT DOCUMENTS

WO 2009064762 A2 5/2009
WO 2012082138 A1 6/2012

* cited by examiner

*Primary Examiner* — David Walczak
(74) *Attorney, Agent, or Firm* — The Webb Law Firm

(57) ABSTRACT

An applicator for applying a liquid medium, in particular a liquid decorative medium in the cosmetic field, includes at least one first section having an applicator head, at least one second section adapted to receive at least one reservoir container for the liquid medium. The reservoir container includes at least one piston and at least one third section having at least one advancing mechanism for emptying the reservoir container by moving the piston. The at least one advancing mechanism can be driven by at least one electrical gear motor. The at least one electrical gear motor is arranged together with the advancing mechanism in the at least one third section of the applicator.

17 Claims, 3 Drawing Sheets

APPLICATOR FOR APPLYING A LIQUID MEDIUM, IN PARTICULAR IN THE COSMETIC FIELD

CROSS-REFERENCE TO RELATED APPLICATIONS

This application is the United States national phase of International Application No. PCT/EP2014/067344 filed Aug. 13, 2014, and claims priority to German Patent Application Nos. 10 2013 216 231.6 and 20 2013 104 192.0 filed Aug. 15, 2013 and Sep. 13, 2013, respectively, the disclosures of which are hereby incorporated in their entirety by reference.

BACKGROUND OF THE INVENTION

Field of the Invention

The present application relates to an applicator for applying liquids, in particular for decorative media in the cosmetic field and the use thereof.

The presently described applicator is usable in different application areas. In the following, it is exemplarily based on the application of nail polish, in particular, of UV curable nail polish and UV gel for nail re-enforcement, wherein the present applicator is also suitable for applying other liquid cosmetics, as for instance color or cleaning agents.

Description of Related Art

Different applicators for applying liquid decorative cosmetics as for instance UV nail polish, UV nail gel or nail re-enforcement are known. An applicator in the area of nail modellage, i.e., for applying UV nail gel or UV nail polish should allow for a uniform liquid application on the curved nail surface and cover it completely. Besides the further requirements for a blot-free application the applicator should also be adaptable to the medium to be applied and should allow a clean working, for instance, in a nail studio.

In particular in nail studios the UV gel and UV nail polish used for the purpose of nail extension with so-called tips and for the purpose of nail re-enforcement is applied by means of a simple brush-type applicator, wherein the brush tip of the applicator is dipped at first into the open container containing the gel or the nail polish and the liquid taken up by the brush tip is subsequently applied to the nail bed to be processed. This working method is connected with substantial contamination of the work place and contains furthermore considerable health risks, since the user breaths the solvent released from the UV gel or UV nail polish.

SUMMARY OF THE INVENTION

The object of the present invention is thus to provide an applicator for a liquid medium of the mentioned kind which does not have disadvantages of the applicators known from the prior art.

Accordingly, an applicator for applying a liquid medium, in particular for a liquid decorative medium in the cosmetic field, is provided, which comprises:

- at least one first section with an applicator head,
- at least one second section adapted to receive at least one reservoir container for the liquid medium, wherein the reservoir container comprises at least one piston, and
- at least one third section having at least one electrical gear motor and at least one advancing mechanism for emptying the reservoir container by moving the piston, wherein the at least one advancing mechanism can be driven by the at least one electrical gear motor.

When looked from the outside, the applicator comprises preferably a housing, which is divided or separated in the mentioned sections B and C, and wherein the section A is added or arranged on the side of the housing adjacent to the section B. The housing is preferably formed cylindrical, in particular circle cylindrical with a circle diameter d and a height or length h. It is also conceivable that the housing is designed such that the circle diameter in the sections B and C is, in each case, different from each other. That means that the section B can have a larger circle diameter than the section C and vice versa.

The housing comprises preferably an upper side and a lower side. The upper side of the housing is defined in particular by the arrangement of a switch to be defined later, for instance in form of a push button as actuating mechanism for the advancing mechanism.

In an embodiment, the at least one applicator head comprises an application tip for applying the liquid medium as for instance UV gel or UV nail polish. The at least one applicator head can also comprise an application tip in form of a cross opening, in particular, a cross opening connected to a spoon shaped tip and/or in form of a cross opening connected to a brush (brush head).

The use of an application tip with cross opening allows the application of a defined and adjustable liquid volumina as for instance an adjustable UV gel volume onto the nail surface. The applicator head with application tip, for instance in form of a cross opening with spoon-shaped tip and optionally brush head can be exchanged and can be arranged in a lid, which can be attached to the applicator, for instance in form of a rotatable cap. This allows a fast and uncomplicated exchange of the applicator head after wear out and change between different liquids and users.

In an embodiment, the second section B of the present applicator is suitable for receiving a cylindrical reservoir container. The cylindrical reservoir container comprises therefore, in each case a circular front side, i.e. the side which is arranged nearest to the applicator head when receiving the reservoir container, and a circular backside, which is arranged accordingly opposite to the front side remote from the applicator head.

The reservoir container used at present, comprises preferably a portion, which opens up towards the applicator head and a piston arranged opposite to the portion opening up and movable in axial direction of the applicator. The portion opening up towards the applicator head is thus arranged in the circular front side of the reservoir container and the piston is arranged in or at the circular back side of the reservoir container. Accordingly, the piston comprises preferably a circular shape with a diameter corresponding essentially to the inner diameter of the reservoir container.

The piston is designed preferably in form of a slidable base acting as a piston.

Between the piston or the base of the reservoir container functioning as a piston and the interior of the reservoir container further layers or coats of different materials are arranged, which counteract a leaking and drying out of the liquid medium of the reservoir container. Thus, a film is adjacent immediately to the base functioning as a piston, followed by a soft layer, for instance of cellulose or foam and a plastic coat as last layer.

The portion of the reservoir container to be opened is closed before use by a suitable closure as for instance a lid or a film. The portion of the reservoir container to be opened can be formed in the size of the complete circumference or the inner diameter of the cylindrical reservoir container or can have also a smaller diameter than the cylindrical reservoir container. In latter case, the opening or the portion of the reservoir container to be opened is arranged in the center of the circumferential surface of the reservoir container. The portion to be opened is preferably closed before use of the reservoir container by a suitable film, for instance plastic film.

In a further embodiment, the advancing mechanism used in the present applicator comprises at least one pressure rod and at least one stamp provided on one end of the pressure rod for moving the piston of the reservoir container. Pressure rod and stamp can be designed in two pieces, wherein pressure rod and stamp are in an operative connection with each other.

In an embodiment, the pressure rod is surrounded by a mantle, with which the pressure rod is in an operative connection. For this purpose, the pressure rod has an external thread with which it can engage the internal thread of the mantle. At the front end of the mantle, i.e., the end of the mantle which is nearest to the piston of the reservoir container, the stamp for moving the piston is in turn provided. Mantle and stamp are preferably connected to each other and are in firm contact with each other. The operative connection between stamp and pressure rod is accordingly effected via the mantle.

The pressure rod, in particular with mantle and stamp, is arranged before use of the applicator preferably in the center of the third, preferably cylindrical section of the applicator and extends in its entire length through the complete third section up to the second section, i.e., the combination of pressure rod, mantle and stamp have a total length, which corresponds to the total length of the third section and does not protrude from the applicator.

As mentioned, the stamp is preferably adapted or arranged at the end of the mantle surrounding the pressure rod, which is adjacent to base and piston of the reservoir container. The stamp can have any, for a person skilled in the art, convenient, in particular circular shape, wherein the diameter of the stamp corresponds preferably to the diameter of the base or piston of the reservoir container.

The movement of the combination of pressure rod, mantle and stamp is triggered preferably by the electrical gear motor, which in turn causes a movement of the piston of the reservoir container, whereby the piston of the reservoir container is slid further into the reservoir container and an emptying of the content of the reservoir container through the opening of the portion of the reservoir container to be opened towards the applicator head is possible.

In a preferred embodiment, the electrical gear motor is firmly connected to the at least one pressure rod.

If the pressure rod is now set into a turn or rotation by the electrical gear motor and thus into a rotating forward movement, then the external thread of the pressure rod engages the internal thread of the mantle. Due to the (forward) rotation movement of the pressure rod, the mantle and the stamp attached thereto are also set into a forward movement and the stamp is pushed onto the piston of the reservoir container, wherein the piston of the reservoir container is slid (forward) into the reservoir container and the content of the reservoir container is pushed out through the applicator head.

When switching the electrical gear motor into the rotation direction opposite to the rotating forward movement of the pressure rod, the pressure rod is rotated out of the mantle. Accordingly, it is possible at present to set the pressure rod into a right or left rotation via the electrical gear. If the pressure rod is now rotated out of the mantle, then the pressure of the stamp onto the piston of the reservoir container is released and the piston is not moved any longer in the reservoir container. The stamp can also be removed out of the reservoir container by the (backward) rotation of the pressure rod. This allows an exchange of an empty reservoir container against a new reservoir container.

In a further embodiment of the present applicator, at least one supporting element or also guiding element for holding and guiding the advancing mechanism is arranges in the third section C. This supporting or guiding element is preferably provided at the mantle surrounding the pressure rod. In an embodiment, the supporting or guiding element consists of a ring enclosing the mantle, for instance rubber ring, at which additional grooves or notches are provided which are in each case opposite to each other. These grooves or notches engage in each case into corresponding rails, which continue in section C at least partially along the inner wall of the applicator housing. This mechanism guarantees a secure guiding of the advancing mechanism, in particular of the mantle in the applicator housing.

In a further embodiment of the present applicator at least one actuating mechanism is provided on the outer side of the applicator housing, in particular, in form of at least one switch, press button or push button for actuating the at least one electrical gear motor. The at least one actuating mechanism for actuating the electrical gear motor and thus also for actuating the advancing mechanism is arranged preferably between the first section A and the second section B, i.e. at the end of the section B adjacent to the section A (i.e. the applicator head) on the outer side of the applicator housing. Accordingly, a switch or button can be arranged on the housing side of the applicator, for instance such that the actuation of the advancing mechanism and thus the application of the nail gel is possible accurate and dosed by a simple push on the button, for instance by the index finger.

The actuating mechanism comprises preferably two switches or push buttons for actuating the electrical gear motor. Thereby, a switch or push button is provided for actuating the forward rotation or forward movement of the pressure rod and the second switch or push button is provided for actuating the backward rotation or backwards movement of the pressure rod.

It can also be provided to connect the at least one actuating mechanism, such as a switch, to the at least one electrical gear motor via at least one connecting cable. Said connecting cable can be an electrical cable that is guided starting at the actuating mechanism along the housing (inside or outside), is introduced into the housing in section C and ends there at the electrical gear motor.

The electrical energy for the at least one electrical gear motor is provided preferably by a direct connection to a power supply, by a battery and/or a rechargeable battery. In case of using a rechargeable battery, a recharger is provided for the rechargeable battery, which is adapted for instance in its dimension to the dimensions of the applicator and can be positioned at the applicator for instance at the free end of section C. The recharger has accordingly also a suitable power supply, for instance in form of an electrical cable connection.

The present applicator can be used for applying a liquid medium, in particular for applying a decorative and/or adhesive medium in the cosmetic field as for instance the nail modellage.

The present applicator is thus in particular suitable for applying liquid media in the nail modellage, as for instance of UV nail polish, UV gels for nail re-enforcement or other liquid media in the cosmetic field.

The advantages of the present applicator, in particular for the mentioned application purposes are manifold. The applicator allows the application of a predefined amount of liquid or gel and the uniform application of liquid or gel. All components required for a gel application, such as brush, reservoir container etc. are arranged in one, preferably closed housing. The requirement of using separate brushes and reservoir containers is thus omitted, whereby the typical contamination of the working area is avoided.

The present applicator allows further an efficient application of the gel such that the gel amount as well as the usually required time for the nail modellage can be shortened and saved. The inhalation of the solvent present in the gels is also avoided and the applicator can be used multiple times.

The specific arrangement of a switch or push button as actuating mechanism allows moreover a simple actuation, for instance solely with one finger of the advancing mechanism for emptying the reservoir container, wherein simultaneously the complete applicator can be hold in one hand. In other words, the present applicator allows the simultaneous holding of the applicator and emptying the reservoir container by simple actuating the actuating mechanism by means of one finger. It is thus not necessary to put aside the applicator during the modellating process in order to effect a filling or emptying of the reservoir container with the complete hand or even with a second hand.

The present applicator is used preferably as follows: at first, the reservoir container containing the liquid media to be applied is introduced into the applicator housing and here, in particular, into the receiving portion in section B, wherein the cover, as for instance a cap or film, on the portion of the reservoir container to be opened is removed before introduction. After introducing the reservoir container, the actuating mechanism, for instance in form of a push button, is actuated, whereby in turn a signal is sent to the electrical gear motor and the advancing mechanism consisting of pressure rod, mantle and stamp is activated and moved. The electrical energy is transferred from the electrical gear motor to the pressure rod as mechanical rotation energy such that the pressure rod moves forward actually rotating and engages in the internal thread of the mantle, whereby the mantle and the stamp arranged on the mantle are moved in direction of the reservoir container and applicator head. The stamp pushes in the following the base of the reservoir container formed as a piston also in direction of the applicator head and further films or plastic layers optionally used for protection storage in the reservoir container are broken up by movement of the piston and are also moved in direction of the applicator head. Due to the forward movement of the piston of the reservoir container in direction of the applicator head a predetermined amount of liquid is pushed out of the reservoir container into the applicator head due to the pressure or pushing of the actuating lever and is finally applied for instance onto the nail to be modelled.

BRIEF DESCRIPTION OF THE DRAWINGS

The invention is subsequently explained with reference to the Figures of the Drawings by means of an example. It shows.

Figure 1:
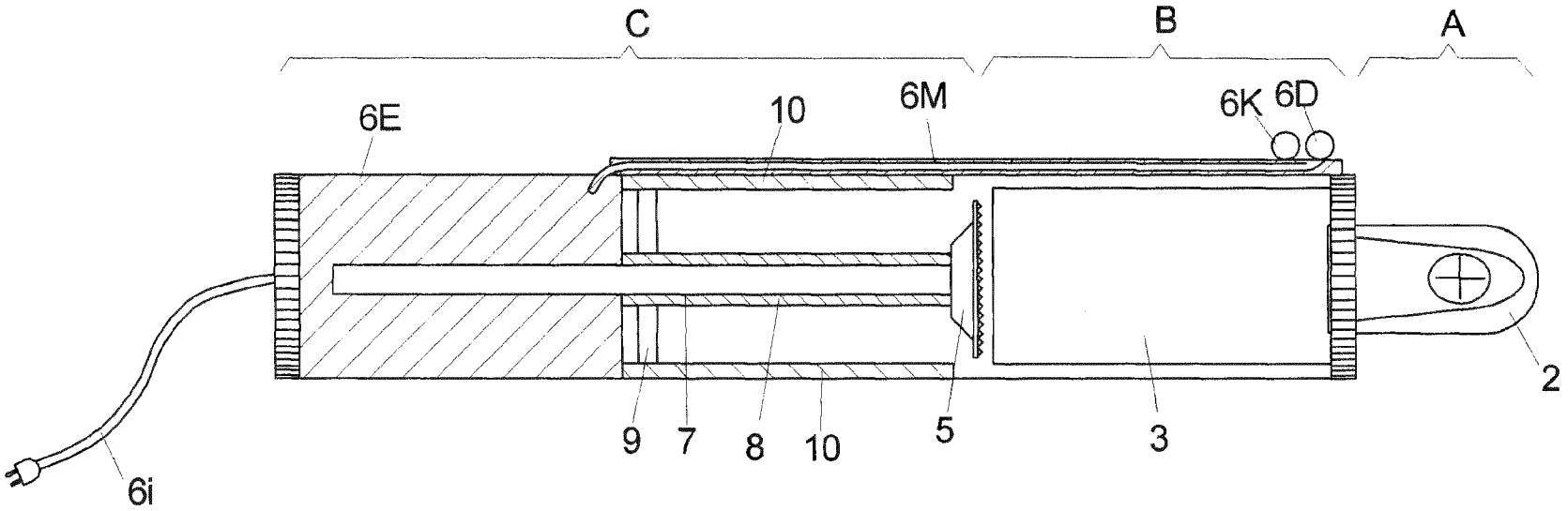
FIG. 1 a schematic side view of an applicator according to a first embodiment, FIG. 2 a schematic side view of an applicator according to a second embodiment, FIG. 3 a schematic view of a guiding element provided on the advancing mechanism, FIG. 4A a schematic view of a first variant of an applicator head, FIG. 4B a schematic view of a second variant of an applicator head, and FIG. 5 a schematic view of a variant of a reservoir container.

A general construction of a first embodiment of the device according to the invention is shown in FIG. 1.

Said first embodiment of applicator 1 comprises a first section A with applicator head 2, a second section B adapted for receiving the cylindrical reservoir container 3 for the liquid medium, wherein the reservoir container comprises a base 4 formed as a piston, and a third section C with an advancing mechanism for emptying the reservoir container 3 by moving the piston 4. The sections B and C of the applicator are arranged in a cylindrical housing.

Figure 4A:
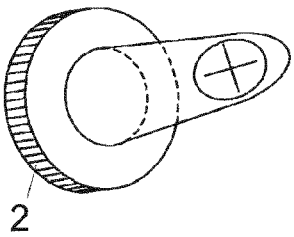
Figure 4B:
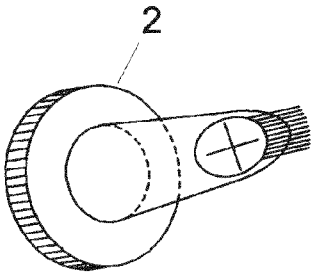

In the embodiment of the applicator 1 according to FIG. 1 the applicator head 2 is formed as a cone, wherein the cone tapers away from the applicator housing. The correspondingly formed tip of the cone-shaped applicator head 2 has a cross-shaped opening, can, however, also be provided in addition with a spoon-shaped end or tip or a brush (see here also FIGS. 4A, 4B). The applicator head 2 is made of a flexible or rigid plastic material.

The reservoir container 3 has the portion 3*a* to be opened, which is arranged in the center on the side of the reservoir container nearest to the applicator head, and which is covered with a film before use of the reservoir container. The reservoir container 3 has also two projections 14, which are in each case arranged on the upper side and lower side of the reservoir container and which are formed for instance of foam or alike and serve for fixation of the reservoir container in the receiving portion of the applicator 1.

Figure 5:
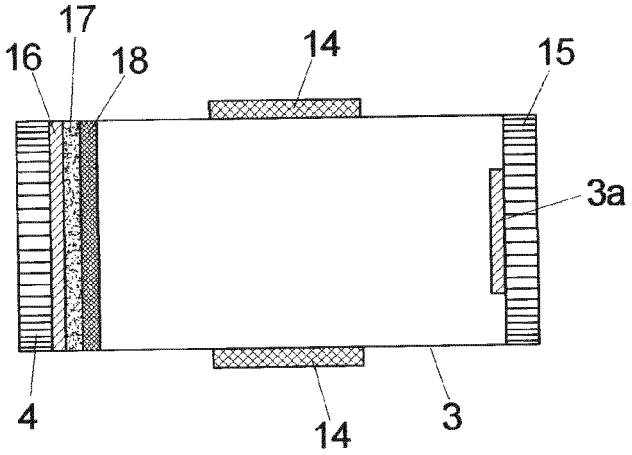

The reservoir container has furthermore a cap 15, which serves as an additional cover of the portion 3*a* to be opened before use of the reservoir container. As mentioned, the reservoir container 3 has a base 4 functioning as piston, which is opposite to the portion 3*a* to be opened and which is joined by multiple layers or coats on the inner side of the reservoir container 3. More precisely, the base 4 is followed by a film 16, a soft layer 17 and a further plastic layer 18 (see also FIG. 5) which prevents a damage of the container and drying out of the medium being in the reservoir container.

The advancing mechanism consists of the pressure rod 7, which engages with its external thread into the internal thread of a mantle 8 surrounding the pressure rod. At the front end of the mantle 8 (i.e. nearest to the reservoir container) a stamp 5 is arranged.

Figure 3:
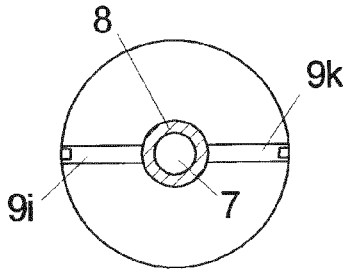

The mantle 8 is surrounded by a ring, for instance rubber ring, as guiding element 9. The guiding element 9 has two guiding notches 9*i*, 9*k*, for instance two grooves, which are opposite on the guiding element (see here FIG. 3). These guiding notches 9*i*, 9*k* can consist of a different material than the guiding ring 9. Said notches 9*i*, 9*k* can consist of a plastic, for instance rigid plastic, which is applied on the surface of the guiding ring 9.

The guiding notches 9*i*, 9*k* engage in each case in the guiding rails 10, which are provided opposite along the section C on the inner side of the applicator housing.

The advancing mechanism is driven by the electrical gear motor 6E, wherein the electrical energy of the motor is converted via a gear into mechanical energy for moving the pressure rod 7 and thus, the mantle 8 and the stamp 5. The electrical motor 6E is provided in the third section C in the applicator housing.

The electrical motor 6E is actuated by actuating two buttons or push buttons 6D, 6K by means of a finger. The push buttons 6D, 6K are provided on the upper side of the applicator housing at the end of section B, which is adjacent to section A. The push buttons 6D, 6K are thus in close proximity to the applicator head 2. When actuating the push button 6D a forward movement or forward rotation of the pressure rod 7 (and thus an engagement of the pressure rod in mantle 8) is effected and when actuating the push button 6K a backward movement or backward rotation of the pressure rod 7 (and thus a release or decoupling of the pressure rod from the mantle 8) is effected.

Push buttons 6D, 6K and the electrical gear motor 6E are connected via an electrical cable 6M. The electrical cable 6M runs from the push button 6D, 6K along the section A of the applicator housing (outside or inside) to section C of the applicator housing, where it is connected to the electrical motor 6E.

The electrical motor 6E is provided with electrical energy in case of FIG. 1 via an external power connection (electrical cable 6*i*). The energy can, however, also be provided by a battery or rechargeable battery, As already mentioned, the pressure rod 7 has an external thread, with which it engages in an internal thread of the mantle 8 (which consists for instance of plastic) surrounding the pressure rod 7. At the end of the mantle 8, nearest to the piston 4 a stamp 5 is in turn provided.

When pushing push button 6D a transfer of a signal via the electrical cable 6M to the electrical motor 6E occurs, which causes a corresponding mechanical (forward) rotational movement of the pressure rod 7. The external thread of the pressure rod 7 engages in the internal thread of the mantle 8. Due to the (forward) rotational movement of the pressure rod 7 the mantle 8 with the stamp 5 arranged thereon is also set into a forward movement and the stamp 5 pushes the piston 4 of the reservoir container 3, wherein the piston 4 of the reservoir container is slidden (forward) into the reservoir container 3 and the content of the reservoir container 3 is pushed out via the applicator head 2. As a result, the stamp 5 contacts and laterally displaces the piston 4. As seen in FIG. 1, the mantle 8 and the stamp 5 are separate from the reservoir container 3.

Stamp 5 pushes the base 4 of the reservoir container towards the applicator head 2, whereby a pre-defined amount of liquid is applied from the reservoir container 3 through the opening 3*a* onto the applicator head 2.

When releasing the push button 6D and thus interrupting the activation of the electrical motor 6*e* at first the forward movement of the pressure rod 7 and the stamp 5 is stopped. The pressure rod 7 remains in a position shifted about a pre-determined amount in axial direction in respect to the position before actuating the push button 6D.

In order to change the empty reservoir container 3 it is necessary to bring the pressure rod 7 with mantle 8 and stamp 5 back into the original position. For this reason a switching of the rotational movement of the pressure rod 7 occurs by actuating the push button 6K such that the pressure rod 7 rotates now in opposite direction and the pressure rod 7 is thereby moved with the stamp 5 out of the empty reservoir container 3.

Figure 2:
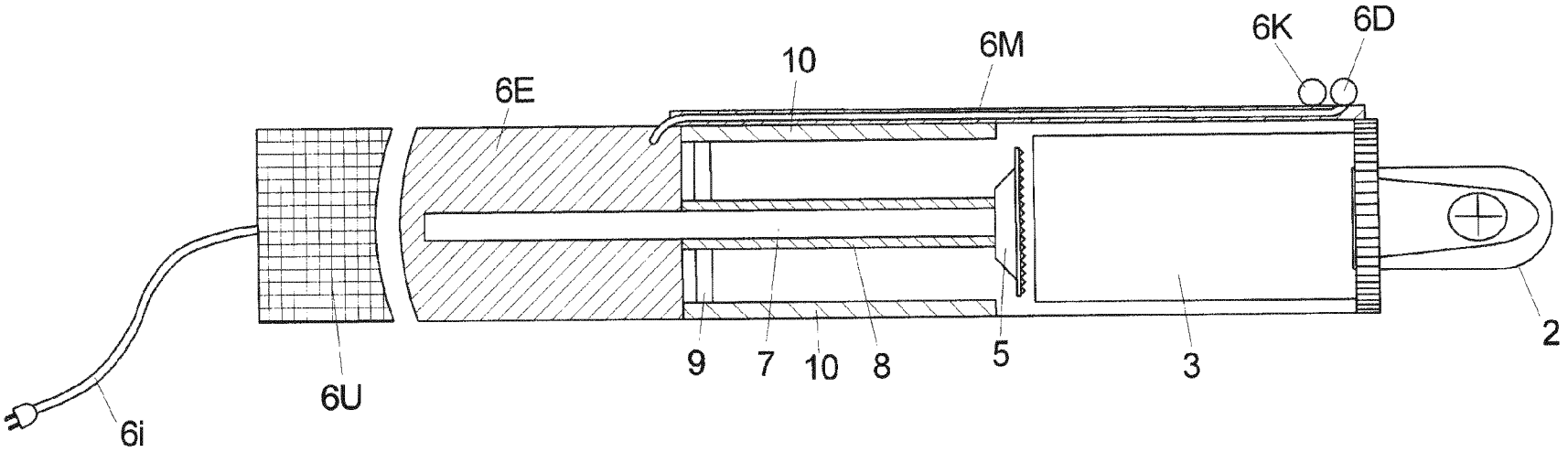

A further embodiment of the present applicator is shown in FIG. 2. The essential construction of the applicator corresponds to the first embodiment of FIG. 1.

Additionally, the applicator according to the second embodiment comprises a recharging device 6U for a rechargeable battery. Accordingly, the power supply of the electrical motor 6E occurs in the embodiment of FIG. 2 by a rechargeable battery, which can be recharged using the recharging device 6U. The recharging device 6U is thereby adapted in its dimensions to the dimensions of the applicator housing and can directly be put on the applicator.

LIST OF REFERENCE SIGNS

1 applicator
2 applicator head
3 reservoir container
3*a* opening of the reservoir container
4 piston
5 stamp
6D first push button as actuating mechanism
6E electrical gear motor
6K second push button as actuating mechanism
6M first electrical cable
6*i* second electrical cable
6U recharging device
7 pressure rod
8 mantle with internal thread
9 guiding element
9*i, k* guiding notches
10 guiding rail
14 fixator
15 cap or lid
16 film
17 soft layer
18 plastic layer
19 cover
A first section
B second section
C third section

The invention claimed is:

1. An applicator for applying a liquid decorative medium in the cosmetic field, comprising:

at least one first section having an applicator head, at least one second section having at least one reservoir container for the liquid medium, wherein the reservoir container comprises at least one piston, at least one third section having at least one electrical gear motor and at least one advancing mechanism for emptying the reservoir container by moving the piston, wherein the at least one advancing mechanism can be driven by the at least one electrical gear motor, and wherein the at least one advancing mechanism comprises at least one pressure rod, at least one mantle surrounding the pressure rod, and at least one stamp provided at one end of the mantle for contacting and laterally displacing the at least one piston within the container, and wherein the mantle and the at least one stamp are separate from the container.

2. The applicator according to claim 1, wherein the at least one applicator head comprises an application tip for applying the liquid medium.

3. The applicator according to claim 1, wherein the at least one applicator head comprises an application tip in form of a cross opening.

4. The applicator according to claim 3, wherein the application tip is in the form of a cross opening with a spoon-shaped end.

5. The applicator according to claim 3, wherein the application tip is in the form of a cross opening connected to a brush.

6. The applicator according to claim 1, wherein the reservoir container is cylindrical and the second section is suitable for receiving the cylindrical reservoir container.

7. The applicator according to claim 1, wherein the reservoir container comprises a portion, which opens up towards the applicator head, and a piston arranged opposite to the opening portion and movable in an axial direction of the applicator.

8. The applicator according to claim 7, wherein the movable piston is designed in form of a base of the reservoir container positioned within and slidable within the container.

9. The applicator according to claim 1, wherein the sections of the applicator are surrounded by a housing.

10. The applicator according to claim 1, wherein on the outer side of an applicator housing at least one switch for actuating the at least one electrical gear motor is provided as an actuating mechanism.

11. The applicator according to claim 10, wherein the at least one switch is connected to the at least one electrical gear motor via at least one connecting cable.

12. The applicator according to claim 1, wherein the at least one electrical gear motor is connected to the advancing mechanism.

13. The applicator according to claim 1, wherein electrical energy for the at least one electrical gear motor is provided by a direct connection to a power supply.

14. The applicator according to claim 13, wherein the power supply is a battery.

15. The applicator according to claim 13, wherein the battery is a rechargeable battery.

16. The applicator according to claim 1, wherein at least one guiding element for guiding the advancing mechanism is provided in the third section.

17. The applicator according to claim 16, wherein the at least one guiding element encloses the at least one mantle of the advancing mechanism.

* * * * *